US005967351A

United States Patent [19]

Ekkert

[11] Patent Number: 5,967,351

[45] **Date of Patent: *Oct. 19, 1999**

[54] TAMPER-INDICATING CLOSURE WITH TAPERED CONNECTORS

[75] Inventor: Len Ekkert, Lemont, Ill.

[73] Assignee: Phoenix Closures, Inc., Naperville, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/890,842

[22] Filed: Jul. 10, 1997

[51] Int. Cl.[6] ..... B65D 41/34

[52] U.S. Cl. ..... 215/252

[58] Field of Search ..... 215/252, 250, 215/253, 320, 354; 220/669, 673, 674

[56] References Cited

U.S. PATENT DOCUMENTS

| | | | |
|---|---|---|---|
| D. 369,749 | 5/1996 | Zemlo et al. | D9/453 |
| D. 370,631 | 6/1996 | Zemlo et al. | D9/453 |
| D. 371,074 | 6/1996 | Zemlo et al. | D9/453 |
| 3,166,829 | 1/1965 | Lemelson | 220/669 X |
| 3,329,295 | 7/1967 | Fields | 215/252 |
| 3,348,718 | 10/1967 | Musy | 215/252 |
| 3,455,478 | 7/1969 | Fields et al. . | |
| 4,048,766 | 9/1977 | Dantzer et al. | 220/601 X |
| 4,147,268 | 4/1979 | Patel et al. | 215/252 |
| 4,156,490 | 5/1979 | Peraboni . | |
| 4,326,639 | 4/1982 | Stahl et al. | 215/252 |
| 4,343,408 | 8/1982 | Csaszar . | |
| 4,352,436 | 10/1982 | Chartier et al. . | |
| 4,432,461 | 2/1984 | Mumford et al. . | |
| 4,436,212 | 3/1984 | Llera . | |
| 4,461,390 | 7/1984 | Csaszar . | |
| 4,479,586 | 10/1984 | Csaszar . | |
| 4,512,490 | 4/1985 | Frei et al. | 220/906 X |
| 4,528,439 | 9/1985 | Frei | 220/673 X |
| 4,549,667 | 10/1985 | Dullabaun . | |
| 4,564,112 | 1/1986 | Breuer | 215/252 X |
| 4,567,993 | 2/1986 | Albrecht et al. . | |
| 4,613,052 | 9/1986 | Gregory et al. . | |
| 4,638,917 | 1/1987 | Perscj | 215/252 |
| 4,664,278 | 5/1987 | Barriac | 215/252 |
| 4,669,623 | 6/1987 | Csaszar . | |
| 4,756,438 | 7/1988 | Ryder . | |
| 4,807,771 | 2/1989 | Roy et al. . | |
| 4,878,589 | 11/1989 | Webster et al. | 215/252 |
| 4,919,285 | 4/1990 | Roof et al. . | |
| 4,957,211 | 9/1990 | Ekkert et al. | 215/252 X |
| 4,978,016 | 12/1990 | Hayes . | |
| 5,007,545 | 4/1991 | Imbery, Jr. | 215/252 X |
| 5,092,478 | 3/1992 | La Pierre . | |
| 5,135,123 | 8/1992 | Nairn et al. . | |
| 5,137,163 | 8/1992 | Moore . | |
| 5,217,128 | 6/1993 | Stenger | 220/669 X |
| 5,219,084 | 6/1993 | King | 215/252 |
| 5,593,056 | 1/1997 | Mero et al. | 220/669 X |

*Primary Examiner*—Stephen K. Cronin
*Assistant Examiner*—Nathan Newhouse
*Attorney, Agent, or Firm*—Welsh & Katz, Ltd.

[57] ABSTRACT

A tamper-indicating closure is used with an associated container having a finish including an external thread formation thereon, and an annular locking ring located axially under the thread formation. The closure includes a closure cap having a circular top wall portion and an annular skirt portion depending from the top wall portion. An internal thread is formed in the skirt and defines a skirt wall plane. The closure includes an annular tamper-indicating band depending from the cap that is detachably connected to the cap by a plurality of circumferentially spaced, tapered, frangible connectors extending between the band and the cap. The connectors taper to define a region adjacent to a juncture of the connector and the band having a cross-section that is smaller than a cross-section at a region of the connector adjacent to a juncture of the connector and the closure cap.

18 Claims, 3 Drawing Sheets

TAMPER-INDICATING CLOSURE WITH TAPERED CONNECTORS

FIELD OF THE INVENTION

This invention relates to a container closure having a tamper-indicating band connected thereto by tapered connectors. More particularly, the invention relates to a tamper-indicating container closure having a closure cap and a tamper-indicating band that is connected to the cap by a plurality of connectors tapered to facilitate molding the closure.

BACKGROUND OF THE INVENTION

Tamper-indicating or tamper-evident closures have become common-place in consumer markets. Typically, a threaded container includes a locking ring, or like annular projection extending from the container finish, adjacent to and below the container threaded portion. The closure includes a cap and a depending tamper-indicating band that separates from the cap upon initial removal of the closure from the container.

Consumers will readily recognize that such closures are used for sealing containers of all types, including milk containers, juice containers, soft drink containers and the like. Those skilled in the art will recognize that such containers can have various sizes of openings and thus various sizes of closure caps. The container opening sizes may be dependent upon, in part, the liquid stored in the container. For example, some types of liquid foods may be best packaged in a container that has a relatively small dispensing opening that provides for directed pouring, while others liquids, such as milk, juice and the like, that are consumed directly from the container may be best packaged in containers having a relatively large dispensing opening.

A typical closure that is fitted to the container includes a plastic closure cap having a circular top wall portion and a depending annular skirt portion. The skirt portion has an internal thread configured to threadedly engage the container thread. Tamper indication is provided by a separable band that extends and depends from the skirt portion. The band engages the locking ring and separates from the skirt portion as the closure is removed from the container.

The band includes bridge-like connectors that extend between the skirt portion and the band. The connectors are designed and formed to break as the closure is initially removed from the container. Exemplary of such a closure is that disclosed in U.S. Pat. No. 5,450,972 to Zemlo, which patent is commonly assigned herewith, and is incorporated herein by reference.

The connectors that extend between the cap and the separable band are typically formed as either discretely formed frangible elements, or they are formed by the area that remains after the closure is scored to form a weakened region. The discretely formed elements generally have a constant cross-sectional area and a constant thickness. Thus, breakage of the connector can occur anywhere along the length of the connector.

The score-formed connectors do not include discretely formed elements. Rather, the closure is molded with the separable band integral with the cap. The closure is then scored to form the separable band at about the end of the depending skirt. The score can be made as a continuous cut line into a portion of the thickness of the skirt, or as a full or through-wall cut at discrete circumferential locations along the skirt, or a combination of the noted score types.

Although these types of bands are well-suited for tamper-indicating closure applications, and are in widespread use, they do have various drawbacks. First, the discretely formed connectors can be difficult to mold. That is, because the connectors are typically extremely thin and are formed having a constant cross-sectional area, they can become lodged or stuck in the closure mold. It will be appreciated that when closures become lodged in the molding apparatus, the molding operation must be stopped and the molding apparatus freed of the troublesome closure.

Moreover, because the connectors have a relatively constant cross-section, they can become damaged when the closure is removed or ejected from the molding apparatus. This is due, in part, to the possible difficulty of effectively ejecting the closure with the small connectors fully intact. In addition, the constant cross-section results in connectors that will fracture or break at any point long their length when the closure is removed from the container. It may, however, be desirable at times, to determine where along the length of the connector fracture will occur, or to increase the probability that fracture will occur at a predetermined location.

With respect to the scored-formed connector, inasmuch as this arrangement functions well, it requires an additional, separate step in the formation of the closure, namely, cutting or scoring the formed closure. As will be recognized, any additional forming step adds equipment cost, and likely processing time to the manufacture of the closures.

Accordingly, there continues to be a need for a closure having a tamper-indicating band, which closure is readily removable from a closure forming mold, without damaging the connectors that extend between the cap and the band. Such a tamper-indicating band will further be configured so that the fracture location along the length of the connector is more readily predetermined.

SUMMARY OF THE INVENTION

A tamper-indicating closure for use with an associated container is disclosed. The associated container has a finish having an external thread formation thereon, and includes an annular locking ring located axially under the thread formation.

The closure includes a closure cap having a circular top wall portion and an annular skirt portion depending from the top wall portion. The skirt portion has an internal thread formed therein threadedly engageable with the container thread formation. An annular tamper-indicating band depends from the cap. The band is detachably connected to the cap by a plurality of circumferentially spaced, tapered, frangible connectors. The band includes an internal surface engageable with the locking ring for separating the band from the cap.

The present tapered connectors advantageously facilitate readily manufacturing the closure. Specifically, the tapered connectors enhance the manufacturing process by providing a closure that is readily ejected or separated from the molding apparatus that is used to form the closure. The taper provides a configuration whereby inadvertent fracture of the connectors during ejection is reduced or eliminated, by eliminating unnecessary contact between the connectors and the mold.

Moreover, the present tapered connectors provide an additional benefit in that upon initial removal of the closure from the container, the location along the length of the connector at which fracture will occur is more readily predetermined. Thus, the connector can be configured so that after fracture, a relatively small portion of the connector remains on the band, while a more substantial portion of the connector remains on the closure cap.

The connectors define a region adjacent to a juncture of the connector and the band that has a cross-section that is smaller than a cross-section at a region of the connector adjacent to a juncture of the connector and the closure cap. In a preferred embodiment, the connectors are tapered in at least one direction. Most preferably, the connectors are tapered in two directions, axially and radially. The connectors can taper downwardly, in an axial direction, at an outer surface thereof at an angle of about 5° to about 6°, and at an inner surface thereof at an angle of about 9° to about 10°. In a radial direction, the connectors can taper inwardly, at an angle of about 20° to about 22°.

In a current embodiment, the closure cap includes a plurality of ribs extending downwardly, in an arcuate manner, from the top wall. Preferably, the ribs are parallel to one another and at least some of the ribs extend between the top wall and the skirt portion. The connectors extend from the band to at least some of the ribs.

The skirt portion defines a skirt wall plane on an interior surface thereof at about the base of the cap threads. The band is preferably sufficiently radially spaced from the skirt wall plane such that said band does not contact the container thread formation when the closure is initially engaged with the container. Optionally, the closure can include an annular, inner depending plug portion depending from the top wall portion inwardly of the skirt portion. The plug facilitates sealing the container contents from the environs.

Other features and advantages of the present invention will be apparent from the following detailed description, the accompanying drawings, and the appended claims.

DETAILED DESCRIPTION OF THE PREFERRED EMBODIMENT

Figure 1:
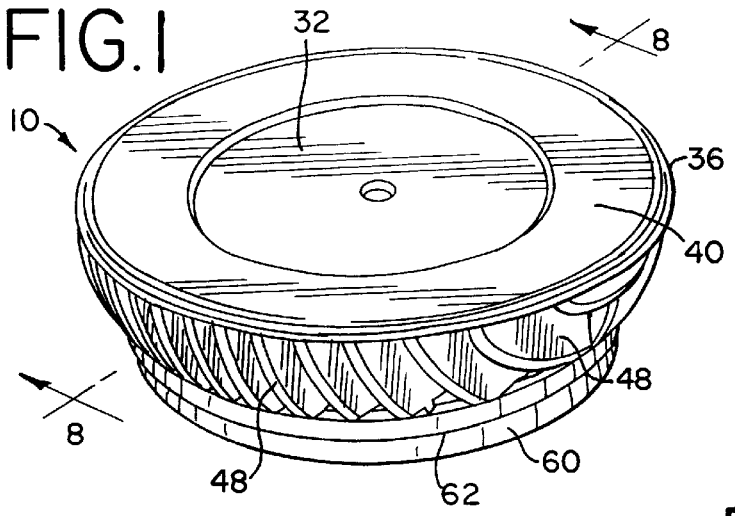
FIG. 1 is a perspective view of an exemplary tamper-indicating closure having tapered connectors, in accordance with the principles of the present invention.
Figure 2:
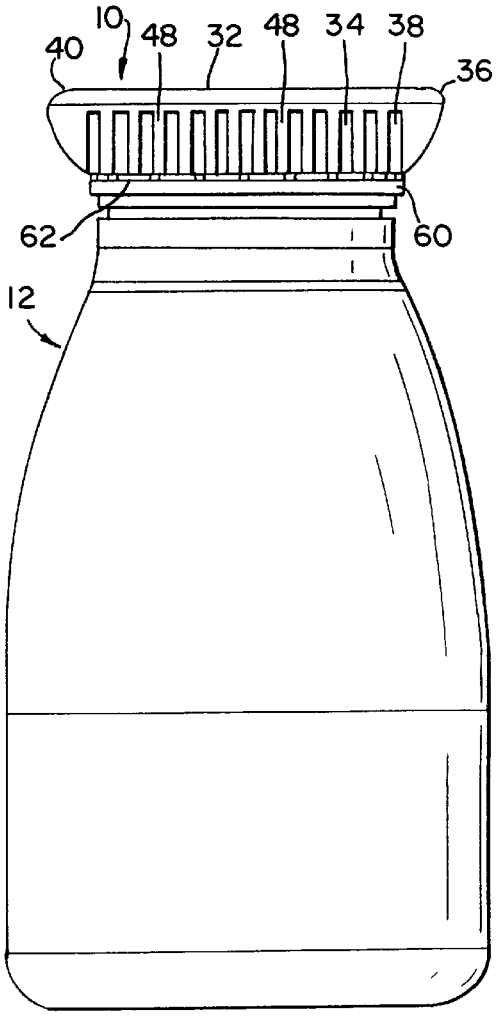
FIG. 2 is side view of the closure of FIG. 1, illustrated threaded onto an associated container.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Figure 9:
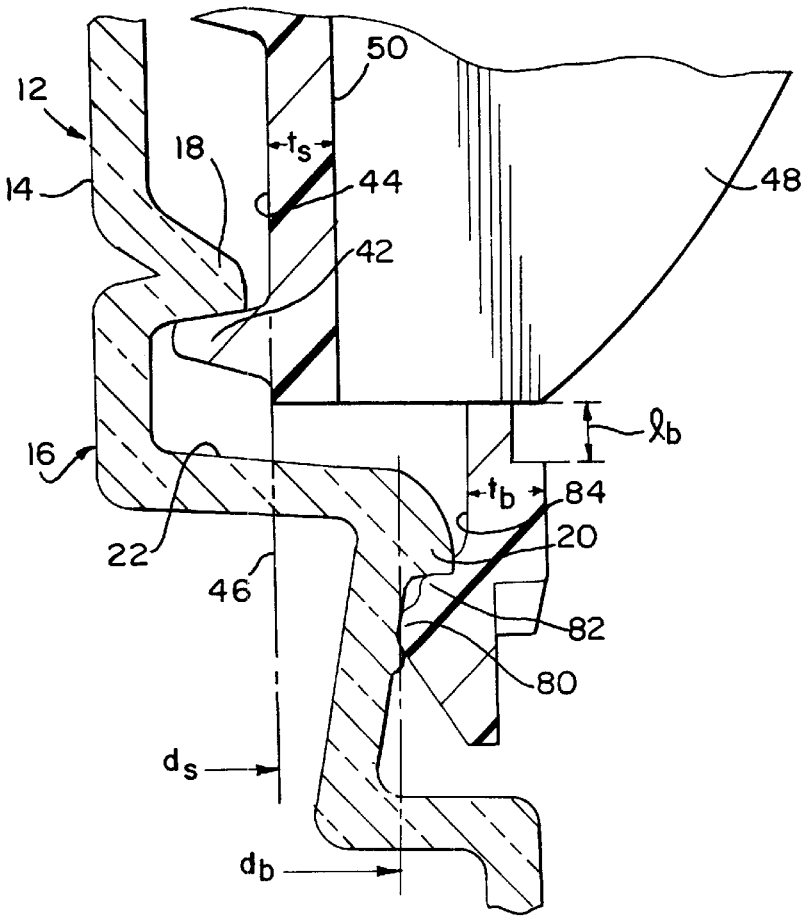
FIG. 9 is a partial cross-sectional view of the closure, similar to FIG. 3, with the closure threadedly engaged with a container, and illustrating the tamper-indicating band engaged with a portion of the container neck.

Referring now to the figures, and in particular to FIG. 1, there is shown a tamper-indicating closure 10 in accordance with the principles of the present invention. The closure 10 is illustrated engaged with a container 12 that may contain, for example, milk. Referring now to FIG. 9, which illustrates the closure 10 and a portion of the container 12 with which the closure 10 is engaged, the container 12 includes a finish portion 14 which is that portion of the container neck 16 that engages the closure 10.

The container finish 14 includes a thread formation 18 thereon and includes a locking or interference ring 20 disposed on the container 12, below the container threads 18. As illustrated, the locking ring 20 can extend from a shoulder 22 formed in the container 12 below the threads 18.

The closure 10 includes a cap 30 having a top wall portion 32 and an annular skirt portion 34 depending from the top wall portion 32. The top wall portion 32 is generally circular, and is integral with the skirt portion 34.

In a present embodiment, the cap 30 includes an oversized or enlarged top wall 32. The top wall 32 defines an outermost edge 36 at the periphery thereof. It is to be understood that the exemplary "enlarged" top wall 32 closure 10 as shown and described herein, is one illustration of a closure that includes tapered connectors. The following description of the closure 10 is not intended to limit the scope of the invention to such a closure 10. Rather, the invention is to be considered applicable to all closures, commensurate with the scope of the appended claims.

The depending skirt portion 34 depends from the top wall portion 32 inwardly of the outermost edge 36. The portion of the top wall 32 outward of the top wall-skirt juncture, as illustrated at 38, defines a top wall extension region 40. The skirt portion 34 includes an internal thread 42 formed therein for engaging the container threads 18. The inner wall 44 of the skirt 34, from which the thread formation 42 extends, defines a skirt wall plane as indicated at 46. The plane 46 extends generally perpendicular to the cap top wall 32.

While the present invention should not be considered limited by illustration and description of the exemplary closure 10, the cap 30 may include a plurality of fin-like elements or ribs 48, at least some of which extend between the top wall portion 32, at about the extension region 40, and an outer wall 50 of the depending skirt 34. The ribs 48 facilitate, in part, readily grasping the closure 10 for turning the closure 10 to remove it from the container 12. Preferably, the ribs 48 have a curved or arcuate shape, curving downwardly and inwardly toward the skirt 34. The ribbed configuration reduces the amount of material required to manufacture the closure 10, and thus reduces the overall weight and the material cost of the closure 10.

In a current embodiment, the ribs 48 are parallel to one another. Alternately, the ribs can be radially oriented. It will be recognized by those skilled in the art that the ribs can have various shapes and sizes, which various shapes and sizes are within the scope of the present invention.

Referring now to FIGS. 3–6 and 8–9, the closure 10 includes a tamper-evident or tamper-indicating band 60 that depends from the cap 30. The band 60 is configured to provide visibly discernible evidence that the closure 10 has been removed from the container 12, that the container 12 may have been opened or that the contents may have been otherwise tampered with.

The tamper-indicating band 60 depends from the cap 30 and is connected thereto by a plurality of circumferentially spaced, tapered, bridge-like connectors 62. The connectors 62 have a length $l_b$, and extend between the band 60 and the cap 30. In a current embodiment, the connectors 62 extend between the band 60 and at least some of the ribs 48 that extend from the cap 30. The connectors 62, which are substantially thinner than the band 60 adjacent thereto, are frangible connections that break or yield as the closure 10 is twisted or threadedly disengaged from the container 12 and as the band 60 is urged outwardly and downwardly from the closure 10.

Figure 5:
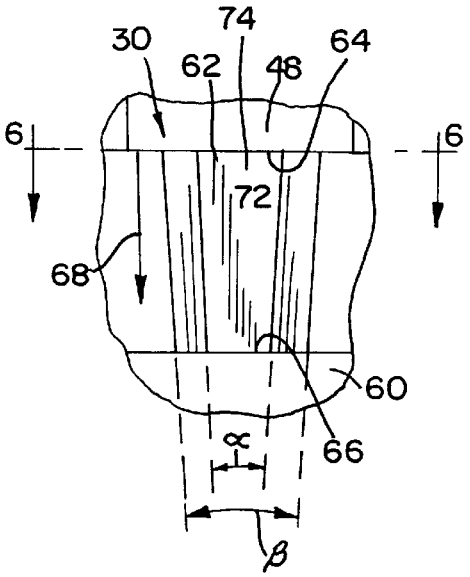
FIG. 5 is an enlarged view of a portion of the closure as indicated in FIG. 4, illustrating the connector extending between the closure cap and tamper-indicating band.
Figure 6:
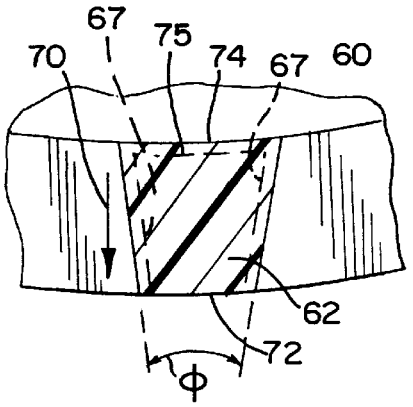
FIG. 6 is a cross-sectional view of the connector taken along line 6—6 of FIG. 5.

Referring to FIGS. 5 and 6, the connectors 62 of the present closure 10 taper inwardly from the cap 30 to the band 60. That is, the connectors 62 have a cross-sectional area at a juncture with the cap 30, as indicated at 64, that is greater than a cross-sectional area of the connectors 62 at a juncture with the band 60, as indicated at 66. Referring to FIG. 6, the cross-sectional area at the connector/band juncture 66 is indicated by the cross-hatched area inside of the dashed lines, indicated at 67, whereas the larger cross-sectional area at the connector/cap juncture 64 is indicated by the entirety of the cross-hatched area.

The connectors 62 can taper in one direction, either axially or radially, as indicated at 68 and 70, respectively. Alternately, the connectors 62 can taper in both the axial and radial directions, 68, 70. That is, the connectors 62 can taper or thin in more than one direction as they extend between the cap 30 and the band 60. It is contemplated that the connectors 62 can also be formed in other shapes, such as, semi-circular or quarter-circular cross-section connectors that extend between the cap 30 and the band 60. Such other shaped cross-sections of connectors are within the scope of the present invention. It is also to be understood that because the connectors 62 are three-dimensional elements, having a height, a width and a depth when viewed as illustrated in FIG. 5, they can be tapered in all such dimensions, which other tapers are within the scope of the present invention.

Advantageously, the tapered connectors 62 facilitate manufacture, and more specifically, molding of the closure 10 and subsequent release or ejection of the closure 10 from the mold. Those skilled in the art will recognize that in an injection molding process, the molded part is created by filling the voids of the mold with, for example, a plastic. After the item is molded, the mold portions must be separated from one another to remove or eject the molded part. The present tapered connectors 62 facilitate ejecting the closure 10 from the mold.

Figure 7A:
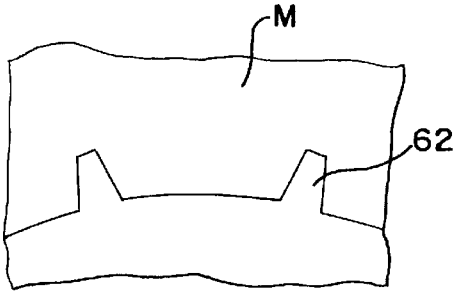
FIGS. 7A and 7B illustrate the forming of the tapered connectors in the closure mold and separation of the connectors from the mold.
Figure 7B:
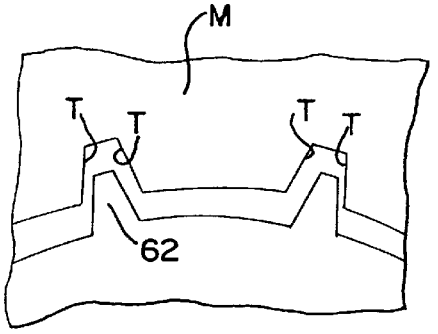

Referring to FIGS. 7A and 7B, which illustrate the non-contacting nature of the mold M separation, the tapers T of the mold M are complementary to the tapers of the connectors 62. That is, where the connectors 62 are closest to one another (for example, at their most inwardly radial location), the mold M portions are spaced furthest from one another. Because the mold M portions are complementary to the connectors 62, they are largest at their most radially outward location. Conversely, the molded connectors 62 are largest at their most radially inward location. Thus, as the mold M portions are separated from one another they are separated in a direction such that the largest of the connector portions 62 does not come into contact with the largest of the mold M portions.

In FIG. 7A, the mold M is illustrated with the molded connectors 62 formed around the mold M surfaces. The connectors are shown with a radial taper. As the mold M is separated, as illustrated in FIG. 7B, the mold M is urged away from the connectors 62 without contact between the mold M and the connectors 62. Although the illustrations of FIGS. 7A and 7B are simplified, they provide an understanding of one advantage that the present tapered connectors 62 provide over known closure arrangements.

Figure 4:
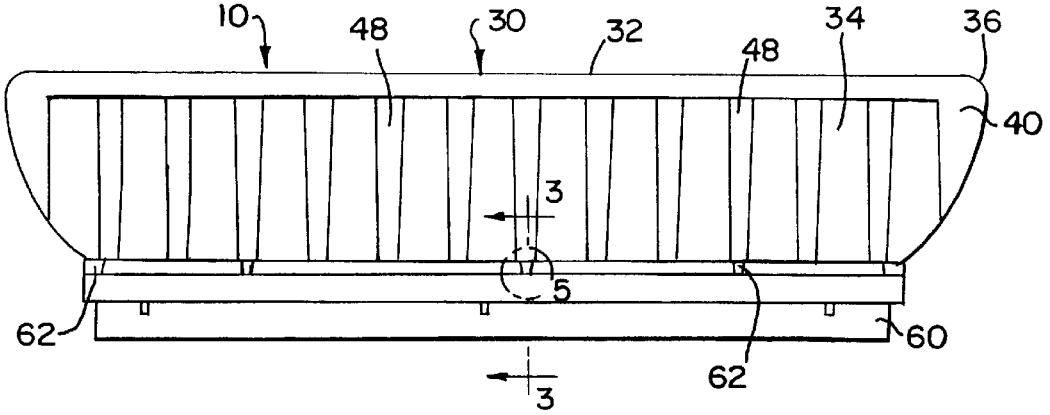
FIG. 4 is a side view of the closure of FIG. 1, as viewed from the left-hand side thereof.

The connectors 62 can taper radially, as indicated at 70, as provided above. The connectors 62 can also taper axially, downwardly, as indicated at 68, from the cap juncture 64 to the band juncture 66. This configuration further facilitates ejection or release of the closure 10 from the mold M. In a current embodiment, the connectors extend from the cap 30 at the ribs 48, to the band 60, as illustrated in FIG. 4.

Referring to FIG. 5, in a preferred embodiment, the connectors 62 taper in the axial direction 68 at an outer surface thereof, as indicated at 72, at an angle $\alpha$ between about 5° and about 6°, and most preferably about 5.7°. At an inner surface of the connector, as indicated at 74, the connector 62 tapers at an angle $\beta$ between about 9° and about 10°, and preferably about 9.5°. In a radial direction, as indicated at 70, the connectors 62 taper at an angle $\Phi$ of about 20° to about 22°, and most preferably at an angle $\Phi$ of about 20.9°.

Figure 3:
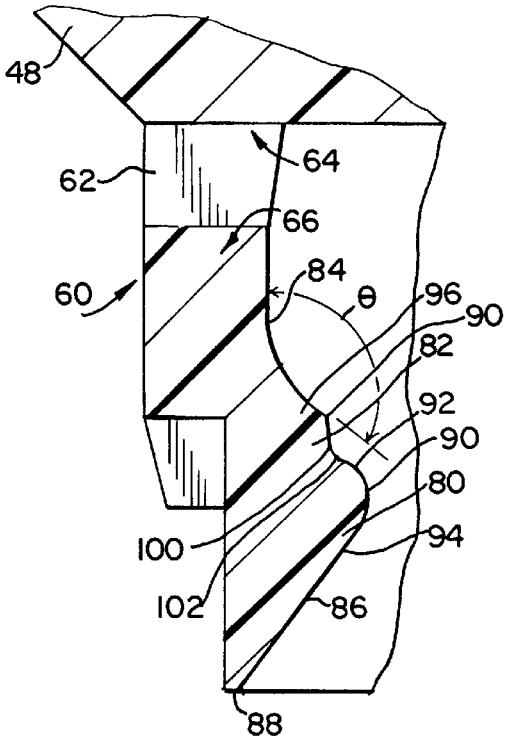
FIG. 3 is a partial cross-sectional view of the tamper-indicating band and connector taken along line 3—3 of FIG. 4.

As discussed above, the connectors 62 can taper in other planes. In one contemplated taper, as viewed from the left-hand side or right-hand side of the connector 62 illustrated in FIG. 5, an angular taper of the outer or inner surfaces 72, 74, or both, can be formed such that the connector 62 has a larger cross-sectional area at the cap juncture 64 that the cross-sectional area at the band juncture 66. For example, the connectors 62 can taper at the inner surface 74, as seen in FIG. 3, and as indicated by the dashed line 75 in FIG. 6.

Advantageously, the present tapered connectors 62 also facilitate increasing the probability of determining the location along the length $l_b$ of the connector 62 at which fracture will occur. That is, whereas in known tamper indicating closures, fracture can occur anywhere along the length of the connector between the cap and the band, in the present closure 10, the specific location of fracture of the connector 62 is more readily predetermined by tapering the connector 62. This can be an important consideration, particularly if a user drinks the contents directly from the container 12.

As best seen in FIG. 9, the band 60 can be connected to the cap 30 such that the entirety of the band 60 is outwardly displaced from the skirt wall plane 46. Essentially, the band 60 lies in a different plane than, and is thus non-coplanar with the skirt wall plane 46.

In a preferred embodiment, the thickness $t_b$ of the band 60 is substantially greater than the thickness $t_s$ of the skirt 34; the band 60 thickness $t_b$ is about 150 percent of the thickness $t_s$ of the skirt wall 34. That is, the band 60 has a thickness $t_b$ of about 0.045 inches, and the skirt wall 34 has a thickness $t_s$ of about 0.030 inches. As is readily apparent, in this configuration, an innermost periphery of the band 34 has a diameter $d_b$ that is substantially greater than the diameter $d_s$ across the skirt wall plane 46.

The radially spaced relationship between the band 60 and the skirt 34 provides a number of advantages. For example, when the closure 10 is initially engaged with the container 12, the band 60 does not contact or minimally contacts the container threads 18, thus reducing the opportunity for inadvertently breaking any of the connectors 62 during initial engagement of the closure 10 and the container 12. In addition, the spaced relationship between the skirt wall plane 46 and the band 60 minimizes the dependence of band 60 design on the skirt wall plane 46, skirt diameter $d_s$ and skirt 34 design because of the spaced, non-coplanar relationship between the band 60 and the skirt 34. With the band 60 configuration minimally dependent upon the skirt wall diameter $d_s$, the more efficient, less breakage prone connectors 62 for connecting the skirt 34 and band 60 can be used.

In one embodiment, as best seen in FIG. 3, the tamper-evident band 60 includes first and second camming projections 80, 82, respectively on an inside surface 84 thereof. The dual camming projections 80, 82 permit initial placement of the closure 10 onto the container 12, while reducing or eliminating the possibility that one or more of the connectors 62 will break, and that the band 60 will separate from the cap 30 as the closure 10 is applied to the container 12. The projections 80, 82 are further adapted to facilitate separation of the band 60 from the skirt portion 34 as the closure 10 is removed from the container 12, to provide tamper indication.

The first camming projection 80 extends inwardly of the band 60 a distance greater than the second camming projection 82. The first camming projection 80 can include an inclined or ramped surface 86 extending from about an end 88 of the band 60, upward to about the peak 90 of the projection 80. The inclined surface 86 facilitates initial application of the closure 10 to the container 12.

The second camming projection 82 is recessed relative to the first projection 80. The second projection 82 extends inwardly of the band 60 a distance less than the first projection 80, and a distance greater than the inside surface 84 of the band 60. Thus, the second camming projection 82 defines an intermediate position relative to the inside surface 84 and the first camming projection 80.

Each of the camming projections 80, 82 includes an upper base portion, a peak and a lower base portion, 92, 90, 94 and 96, 98, 100, respectively for the first and second projections 80, 82. The peaks 90, 98 which define the inwardly most extending portion of their respective projections 80, 82 are curved or arcuate surfaces.

The upper base portion 96 of the second projection 82 defines an angle θ relative to the inside wall. As best seen in FIG. 3, the upper base portion 96 is at an angle θ of about 131° relative to the inside wall. The lower base portion 100 of the second projection 82 and the upper base portion 92 of the first projection 80 define a transition region 102. In a preferred embodiment, the transition region 102 defines an arcuate or curved surface. In a most preferred embodiment, the second projection lower base portion 100, between the peak 98 and the transition region 102 is arcuate, i.e., concave, relative to the projections 80, 82.

As will be apparent from the figures, as the closure 10 is applied to the container 12, the band 60 readily passes over the container threads 18 with minimal, if any contact therebetween. It is contemplated that a conventional capping method will be used to initially engage the closure 10 to the container 12. Thus, the method would comprise screwing the closure 10 onto the container 12 whereby the closure threads 42 engage the container threads 18 while the band 60 slides down and over the locking ring 20, as illustrated in FIG. 9.

As the band 60 slides over the ring 20, the first camming projection 80 is forced over the ring 20 and urges the band 60 outwardly. As the first camming projection 80 passes over and beyond the ring 20, the second camming projection 82 precludes an excessive inward and downward snap-back action of the band 60 by engaging the ring 20. The snap-back effect has been observed to break connectors on some known closures. Thus, the second projection 82 dampens and reduces the snap-back effect and produces a two-stage return of the band 60 to its non-stressed, pre-application state, with the band 60 disposed below the ring 20. The closure 10 is then fully applied to the container 12, and the band 60 comes to rest with the first camming projection 80 at about the interference ring 20.

It has been observed that the two-stage return of the band 60 to its non-stressed state reduces the opportunity for, and may preclude, inadvertently breaking the connectors 62 which can otherwise result from the snap-back action. The snap-back action has been observed to produce axial and radial stresses in the connectors 62, other than the stresses which result from the outward urging of the band 60 relative to the cap 30 during application. These additional axial and radial stresses could result in tearing the connectors 62 in either or both the radial and axial directions as the closure 10 is applied to the container 12.

When it is desired to access the contents of the 12 container and to remove the closure 10, the closure 10 is grasped about the top wall 32 and ribs 48, and the closure 10 is twisted off. As twisting torque is applied to remove the cap 30, the second camming projection 82 contacts and engages the interference ring 20, which urges the band 60 outward. Continued twisting of the closure 10 contacts the first camming projection 80 with the interference ring 20 which urges the band 60 further outward.

As the closure 10 is rotated further along the container 18 threads, the upward force translated from the twisting motion, along with the outward urging of the band 60 creates a tearing or severing force on each of the connectors 62, which breaks the connectors 62. The connectors 62 may break in a sequential manner. The tearing force is a result of the cap 30 being forced upward relative to the container 12, while the band 60 is obstructed from upward movement due to the contact between the interference ring 20 and the camming projection 80.

In addition to breaking sequentially, the connectors 62 may break or fracture at a location in close proximity to the band 60, rather than farther along the connector 62, for example, at the cap 30. As discussed above, such a predictive fracture location advantageously results in the band 60 remaining on the container 12 with a relatively small portion of the connector 62 remaining on the band 60, and a more substantial portion of the connector 62 remaining on the cap 30.

Such predictive fracture location can be an important consideration if a user drinks directly from the container 12, rather than pours the contents therefrom, into, for example, a drinking glass. It will be readily recognized that the fractured connector 62 may not have a smooth surface at the fracture location, but may have one or more sharp or pointed areas. When a substantial portion of the fractured connector 62 remains on the band 60 around the container neck 16, an individual who is drinking directly from the container 12 is more likely to cut, abrade or injure his or her lip on the connector 62 portion. Thus, the present connectors 62, which provide a more predictable or determinable fracture location, can reduce the possibility of lip injury due to accidental contact with the connector 62 portion that remains on the band 60 around the container neck 16.

Figure 8:
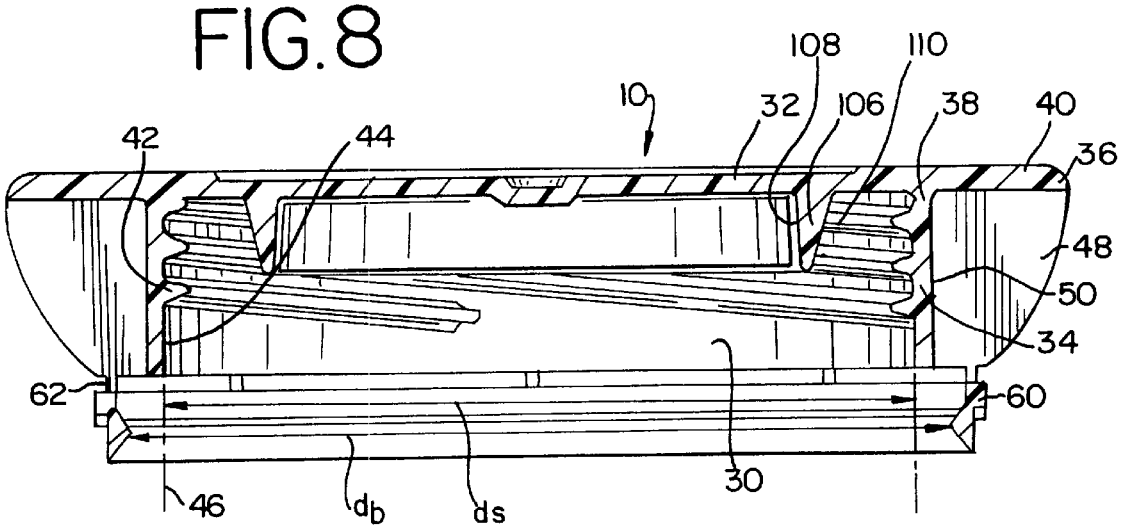
FIG. 8 is a cross-sectional view of the closure taken along line 8—8 of FIG. 1.

As is best seen in FIG. 8, the closure 10 may include a plug 106 that depends from the top wall 32, annularly disposed relative to the skirt 34. The plug 106 has an inner surface 108 and an outer surface 110. The outer surface 110 is configured to engage the container neck 16 at about the inner surface thereof, such that the container neck 16 is positioned between the plug 106 and the skirt 34 when the closure 10 is engaged with the container 12. The plug 106 enhances the seal between the container contents and the environs.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A tamper-indicating closure for use with an associated container, the container having a finish with an external thread formation thereon and including an annular locking ring located axially under the thread formation, the closure comprising:

a closure cap having a circular top wall portion and an annular skirt portion depending from said top wall portion, said skirt portion having an internal thread formed therein threadedly engageable with the container thread formation; and a continuous annular tamper-indicating band depending from said cap and being detachably connected to said cap by a plurality of circumferentially spaced, frangible connectors, said band having a substantially constant radial cross-section along its circumferential length, and including an internal surface engageable with said locking ring for separating said band from said closure cap, each of said connectors defining a region adjacent to a juncture of said each connector and said band having a first cross-section that is smaller than a second cross-section at a region of said each connector adjacent to a juncture of said each connector and said closure cap, said connectors tapering in a radial direction having a cross-section decreasing with an increase in distance from a longitudinal axis of said cap such that a chord on an inner surface of each of said connectors is longer than a chord on an outer surface of each of said connectors, each said connector defining a substantially trapezoidal cross-section when said cross-section is taken in an axial direction.

2. The tamper-indicating closure in accordance with claim 1, wherein said skirt portion defines a skirt wall plane, and wherein said band and said connectors are sufficiently radially spaced from said skirt wall plane such that said band does not contact the container thread formation when said closure is initially engaged with the container.

3. The tamper-indicating closure in accordance with claim 1, wherein said cap includes an annular, inner depending plug portion depending from said top wall portion inwardly of said skirt portion.

4. The tamper-indicating closure in accordance with claim 1, wherein said connectors taper in at least one direction.

5. The tamper-indicating closure in accordance with claim 4, wherein said connectors taper in two directions.

6. The tamper-indicating closure in accordance with claim 1, wherein said connectors taper downwardly, in an axial direction, at an outer surface thereof at an angle in a range between 5° and 6°.

7. The tamper-indicating closure in accordance with claim 6, wherein said angle is 5.7°.

8. The tamper-indicating closure in accordance with claim 1, wherein said connectors taper downwardly, in a axial direction, at an inner surface thereof at an angle in a range between 9° and 10°.

9. The tamper-indicating closure in accordance with claim 8, wherein said angle is 9.5°.

10. The tamper-indicating closure in accordance with claim 1, wherein said connectors taper inwardly, in a radial direction, at an angle in a range between 20° and 22°.

11. The tamper-indicating closure in accordance with claim 10, wherein said connectors taper inwardly, in a radial direction, at an angle of 21°.

12. The tamper-indicating closure in accordance with claim 1, wherein said closure cap includes a plurality of ribs extending downwardly from said top wall, wherein said connectors extend between at least some of said ribs and said band.

13. The tamper-indicating closure in accordance with claim 12, wherein said plurality of ribs are parallel to one another.

14. The tamper-indicating closure in accordance with claim 12, wherein said ribs have an arcuate shape.

15. The tamper-indicating closure in accordance with claim 12, wherein at least a portion of said top wall portion is formed by said ribs.

16. A tamper-indicating closure for use with an associated container, the container having a finish with an external thread formation thereon and including an annular locking ring located axially under the thread formation, the closure comprising:

a closure cap having a circular top wall portion and an annular skirt portion depending from said top wall portion, said skirt portion having an internal thread formed therein threadedly engageable with the container thread formation; and a continuous annular tamper-indicating band depending from said cap and being detachably connected to said cap by a plurality of circumferentially spaced, tapered, frangible connectors, said band having a substantially constant radial cross-section along its circumferential length, and including an internal surface engageable with said locking ring for separating said band from said closure cap, each of said connectors being tapered inwardly in a radial direction and downwardly in an axial direction as they extend between said closure cap and said band to define a region adjacent to a juncture of said each connector and said band having a first cross-section that is smaller than a second cross-section at a region of said each connector adjacent to a juncture of said each connector and said closure cap such that a chord on an inner surface of each of said connectors is longer than a chord on an outer surface of each of said connectors, said connectors tapering in a radial direction having a cross-section decreasing with an increase in distance from a longitudinal axis of said cap, each said connector defining a substantially trapezoidal cross-section when said cross-section is taken in an axial direction.

17. The tamper-indicating closure in accordance with claim 16, wherein said connector is largest at said first cross-section and is smallest at said second cross-section.

18. The tamper-indicating closure in accordance with claim 16, wherein said connectors taper downwardly, in an axial direction, at an outer surface thereof at an angle of about 5° to about 6°, taper downwardly, in a axial direction, at an inner surface thereof at an angle of about 9° to about 10°, and taper inwardly, in a radial direction, at an angle of about 20° to about 22°.

* * * * *